United States Patent [19]

Moriya

[11] Patent Number: 4,662,320

[45] Date of Patent: May 5, 1987

[54] WATER PUMP SYSTEM FOR WATER-COOLED INTERNAL COMBUSTION ENGINE

[75] Inventor: Takashi Moriya, Saitama, Japan

[73] Assignee: Honda Giken Kogyo Kabushiki Kaisha, Tokyo, Japan

[21] Appl. No.: 732,446

[22] Filed: May 9, 1985

[30] Foreign Application Priority Data

May 10, 1984 [JP] Japan ..... 59-93767

[51] Int. Cl.[4] ..... F01B 5/12

[52] U.S. Cl. ..... 123/41.44; 123/90.31; 123/198 C

[58] Field of Search ..... 123/41.44, 41.46, 41.47, 123/198 C, 90.31

[56] References Cited

U.S. PATENT DOCUMENTS 4,114,586 9/1978 Fujikawa et al. ..... 123/198 C
4,212,270 7/1980 Nakanishi et al. ..... 123/41.44
4,615,308 10/1986 Asanomi et al. ..... 123/198 C

FOREIGN PATENT DOCUMENTS 1567303 5/1980 United Kingdom ..... 123/41.47

*Primary Examiner*—William A. Cuchlinski, Jr.
*Attorney, Agent, or Firm*—Lyon & Lyon

[57] ABSTRACT

A water pump system for the cooling system of a internal combustion engine wherein the water pump is directly connected to and driven by the engine cam shaft. The water pump shaft is in axial alignment with and coupled to the cam shaft.

7 Claims, 4 Drawing Figures

FIG. 3.
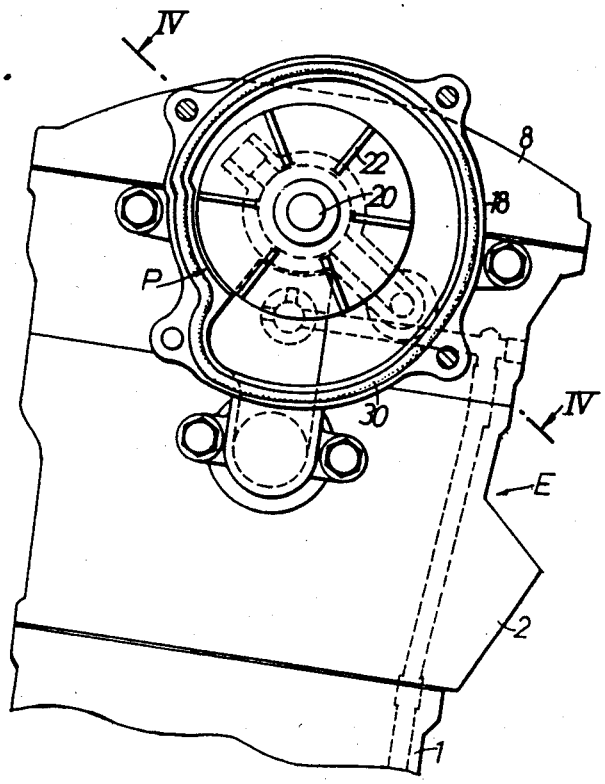
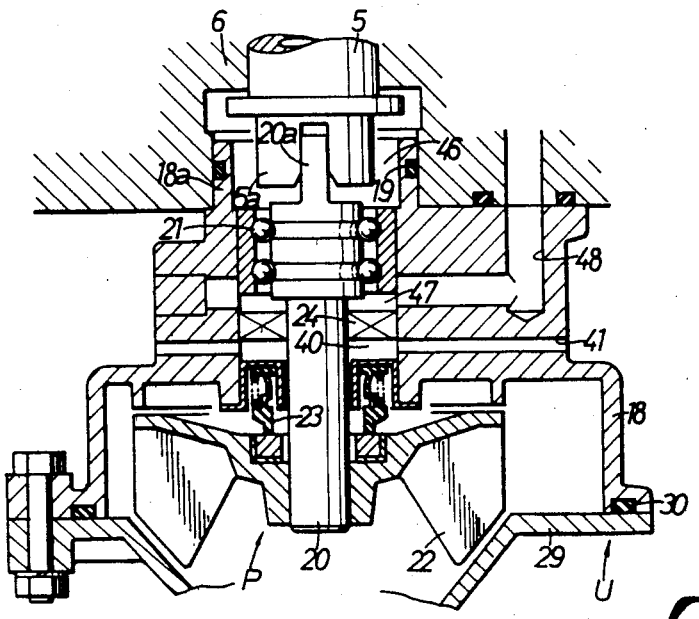
FIG. 4.

WATER PUMP SYSTEM FOR WATER-COOLED INTERNAL COMBUSTION ENGINE

The present invention relates to an arrangement driving a water pump for water-cooled type internal combustion engine and which is particularly suited for an automobile engine for conserving space and improving dependability.

In conventional water-cooled internal combustion engines the water pump is normally attached to the engine body and driven separately together with a generator or other auxiliary device by means of a V-belt interconnected with the crank shaft. In all of such internal combustion engines, the shaft of the water pump is supported in an overhung manner by one end face of the engine body and the V-belt engages a driven pulley which is integral with the pump shaft. Consequently, the pump shaft is subjected to strong external forces in radial directions induced by the tension of the belt, so that a large bending moment is exerted on the bearings which support the pump shaft. The pulley and pump shaft are also subjected to vibrations, as well as acceleration and deceleration forces, caused by the V-belt and engine operation. As a result, it becomes necessary that the pump shaft bearings have a capacity large enough to fully withstand such large bending moments and other forces, and the necessary characteristics of a mechanical seal of the water pump to avoid premature deterioration and failure of the pump shaft. Further, the V-belt for driving the water pump requires space at the end of the engine in the direction of the crankshaft, thus resulting in increased length of the entire engine.

Various arrangements have been suggested by prior art patents for driving the auxiliary mechanisms on an internal combustion for automobiles, such as; employing external surface of the timing belt to drive the water pump and fan, U.S. Pat. No. 3,603,296; or an accessory drive unit including a drive shaft for driving the oil pump, fuel pump, water pump and fan, U.S. Pat. No. 3,613,645; and driving the oil pump directly from the cam shaft of an engine with horizontal cylinders, U.S. Pat. No. 4,446,828. However, no prior art systems of which applicant is aware provide a simple, space saving and dependable drive for the water pump which is a notorious maintenance and failure problem with automobiles.

It is an object of the present invention to provide a novel water pump driving system for an internal combustion engine capable of driving a water pump directly through the valve actuating cam shaft of the engine and thereby eliminating the above-mentioned problems.

In accordance with the present invention, in a water-cooled internal combustion engine of the type in which a valve actuating cam shaft for operation of a valve actuating mechanism is driven by a crankshaft through a timing transmission mechanism, a driven pulley of the timing transmission mechanism is fixed to one end of the valve actuating cam shaft, and a water pump of the water-cooling system is directly coupled to the other end of the valve actuating cam shaft to be driven directly by the valve actuating cam shaft smoothly and effectively without any bending force acting on the pump shaft.

A preferred embodiment of this invention will be described in connection with the drawings thereof, wherein:

FIG. 3 is an enlarged sectional end view taken substantially on the line III—III in FIG. 2.

FIG. 4 is an enlarged sectional side view taken substantially on the line IV—IV in FIG. 3 and showing the water pump.

Figure 1:
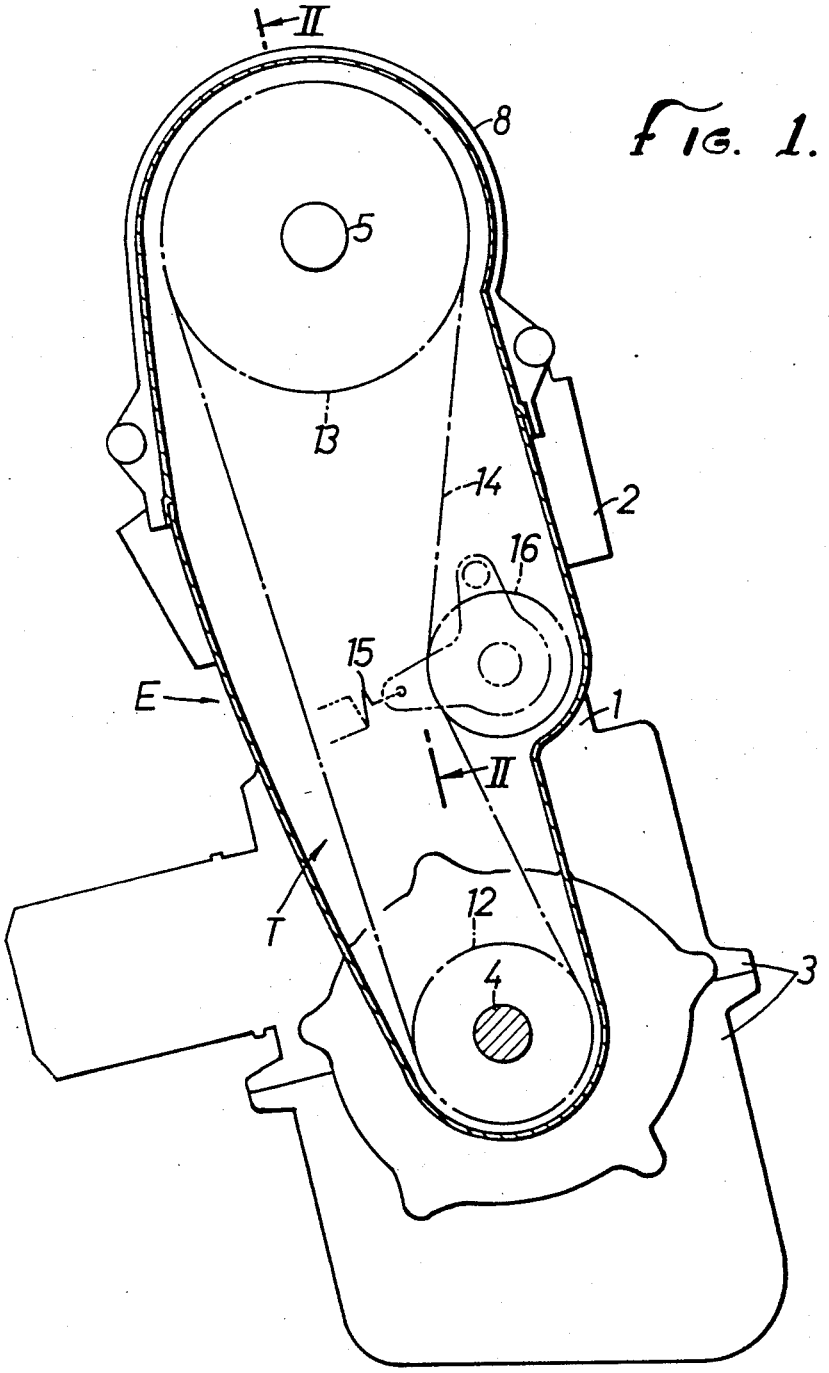
FIG. 1 is an end view of an internal combustion engine from the timing belt drive end with the cover for the timing belt in section.

Referring now in detail to the drawings, a water-cooled type internal combustion engine, generally designated E, includes a cylinder block 1, a cylinder head 2 and a crankcase 3 which are joined together in a conventional manner.

In the crankcase 3 is rotatably supported a crankshaft 4. A valve actuating cam shaft 5 parallel to the crankshaft 4 is rotatably supported in the cylinder head 2 through a plurality of bearings 6. A piston 9 is slidably fitted in each cylinder within the cylinder block 1 and it is connected to a crank pin of the crankshaft 4 through a connecting rod in a known manner. Further, the valve actuating cam shaft 5 is integrally formed with a plurality of valve actuating cams 10 and 11 for intake and exhaust, which are interconnected with intake and exhaust valves (not shown) through any conventional valve actuating mechanism. Above the cylinder head 2 is mounted a cover 8 which covers the valve actuating mechanism.

The ends of the crankshaft 4 and valve actuating cam shaft 5 project outwardly from one end of the engine body E and are drivingly connected through a timing transmission mechanism T. The timing transmission mechanism T comprises a driving pulley 12 fixed to one end of the crankshaft 4, a driven pulley 13 fixed to one end of the valve actuating cam shaft 5, and an endless timing belt 14 stretched between the pulleys 12 and 13. Further, a tension pulley 16 is in pressure contact with an outer slack side of the belt 14 by means of a spring 15, whereby the timing belt 14 is maintained at a substantially constant tension. The rotation of the crankshaft 4 is transmitted at a reduction ratio of ½ to the valve actuating cam shaft 5 through the driving pulley 12, timing belt 14 and driven pulley 13.

Figure 2:
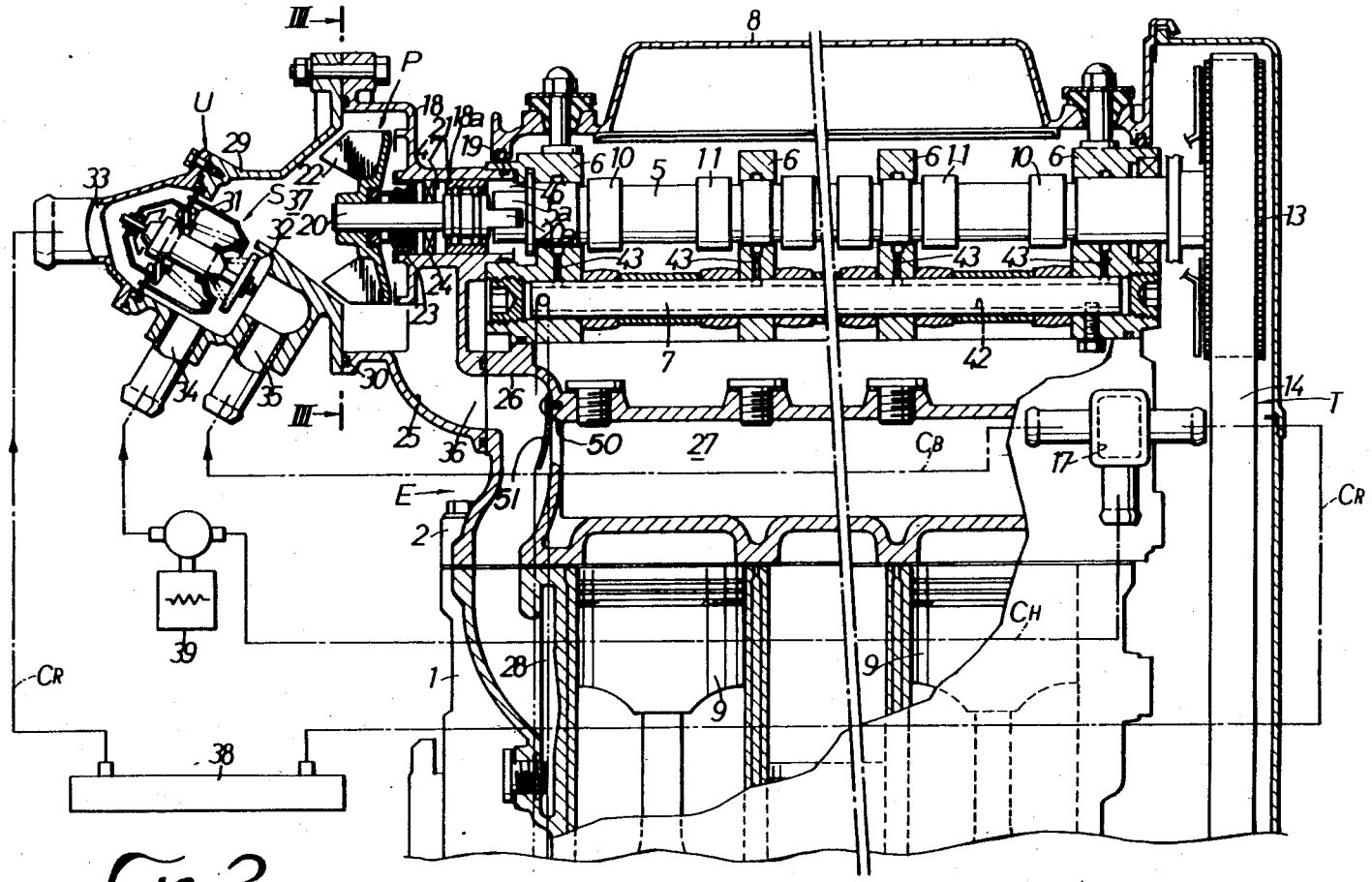
FIG. 2 is an enlarged sectional side view of the engine taken substantially on the line II—II in Fig. 1 with components of the engine cooling system shown diagrammatically.

The other end of the valve actuating cam shaft 5, on the end opposite to the timing transmission mechanism T, has an extending end integrally formed with a connection terminal 5*a*. The connection terminal 5*a* is at one end face of the cylinder head 2 past the last bearing 6 at an outer extending end portion (left side in FIG. 2) of the valve actuating cam shaft 5. A pump housing or case 18 is mounted on that end of the cylinder head 2 so as cover the connection terminal 5*a*. A bearing cylinder 18*a* of the pump case 18 is fitted in a bearing hole formed in the end of the bearing 6 through a packing 19. In the bearing cylinder 18*a* of the pump case 18 is rotatably supported a pump shaft 20 of a water pump P through a ball bearing 21, the axis of the pump shaft 20 being aligned with that of the valve actuating cam shaft 5. The base end of the pump shaft 20 is integrally formed with another connection terminal 20*a* which is connected disengageably to the connection terminal 5*a* at one end of the valve actuating cam shaft 5, whereby the valve actuating cam shaft 5 and the pump shaft 20 are directly coupled together. To the fore end of the pump shaft 20 is fixed an impeller 22 which is located in the pump chamber of the pump case 18, and a mechanical seal 23 and an oil seal 24 are interposed between the impeller 22 and the ball bearing 21, whereby the pump chamber and the valve actuating cam chamber in the cylinder head 2 are sealed in a liquid-tight manner. When the valve actuating cam shaft 5 is rotated, the water pump P which is directly coupled thereto is driven directly. A discharge passage 25 formed in the pump case 18 has an outlet port 36 in communication with a cooling water inlet port 26 formed in the cylinder head 2, the inlet port 26 being communicated with water jackets 27 and 28 formed in the cylinder head 2 and cylinder block 1.

A thermostat housing or case 29 is mounted by bolts on the open end face on the suction side of the pump case 18 through a packing 30 to constitute a combined housing or case U. In the thermostat case 29 is enclosed a wax type thermostat S, of a known structure, which includes a thermostat valve 31 and a by-pass valve 32. The thermostat case 29 has a first inlet port 33, a second inlet port 34 and a third inlet port 35 with a single outlet (unnumbered) which communicates fully with a suction port 37 of the water pump P. The first inlet port 33 and the cooling water outlet 17 formed in opposite end of the engine body E are interconnected through a radiator circuit $C_R$; the second inlet port 34 and the cooling water outlet 17 are interconnected through a heater circuit $C_H$; and the third inlet port 35 and the cooling water outlet 17 are interconnected through a by-pass $C_B$. Further, the first inlet port 33 is communicated with the suction port 37 of the water pump P through the thermostat valve 31; the third inlet port 35 is communicated with the suction port 37 through the by-pass valve 32; and the second inlet port 34 is communicated with the suction port 37 independently of the opening and closing of the thermostat 31 and by-pass valve 32. When the engine is cold, for example at the time of start-up of the engine, the thermostat valve 31 is closed, while the by-pass valve 32 is open as shown in the drawings, so that the cooling water which flows with operation of the water pump P circulates between the by-pass circuit $C_B$ and the engine body E to accelerate warming up of the engine body E. As the cooling water temperature rises with continuous operation of the engine, the thermostat valve 31 opens, while the by-pass valve 32 closes, so that the cooling water circulates between the radiator circuit $C_R$ and the engine body E, and the cooling water which has become hot is allowed to cool by a radiator 38 in the radiator circuit $C_R$.

The cooling water flows through the heater circuit $C_H$ at all times independently of the opening and closing of the thermostat valve 31 and by-pass valve 32, whereby the heater 39 is always available for operation.

A drain passage 41 is formed in pump case 18 for communication with the chamber 40 defined between the mechanical seal 23 and the oil seal 24 in the case 18. Any water or steam leak into the chamber 40 is discharged to the exterior through the drain passage 41.

A lubricating system is provided for the valve actuating mechanism and the water pump P and may be in the form shown. Within the rocker arm shaft 7 of the valve actuating mechanism is longitudinally formed a main oil supply passage 42 which communicates with an oil pump driven by the crankshaft 4. The lubricating oil flowing through the main oil supply passage 42 passes through oil passages 43 formed in the bearings 6 and is fed to the bearing portions of the valve actuating cam shaft 5. As clearly shown in FIG. 4, an oil sump 46 which communicates with an oil passage 43 is formed in a left side portion of the leftmost bearing 6. The oil sump 46 is communicated with an oil supply passage 47 which is formed in the bearing cylinder 18*a* of the pump case 18. The oil supply passage 47 communicates with a drain passage 48 formed in both pump case 18 and cylinder head 2. Within the oil supply passage 47 is disposed the ball bearing 21, to which is fed the lubricating oil flowing through the passage 47. The pump chamber side of the oil supply passage 47 is sealed with the oil seal 24. The chamber 40 and drain 41 prevent any water from entering oil passage 47 even if seal 24 leaks.

When the engine is operated and the crankshaft 4 rotates, the valve actuating cam shaft 5 is driven through the timing transmission mechanism T and causes the intake and exhaust valves to open and close through the valve actuating mechanism in a conventional manner. Further, the water pump P coupled directly to the valve actuating cam shaft 5 is driven, so that the cooling water circulates between the engine body E and the water cooling device as previously described. A flow control valve 51 may be provided on inlet port 50 to the water jacket 27 of the cylinder head 2 for controlling the flow of cooling water into the cylinder head. The flow control valve is temperature sensitive to remain closed or nearly closed when the cooling water is cold to enhance the engine warm-up and thereafter opens for optimum cooling.

Part of the pressurized lubricating oil from the oil pump which is driven during operation of the engine, is introduced into the main oil supply passage 42 in the rocker arm shaft 7, then passes through the oil passages 43 and is fed to the bearing portions of the valve actuating cam shaft 5 to lubricate the bearing surfaces. Part of the lubricating oil which has lubricated the valve actuating cam shaft 5 through the oil pasage 43 formed in the leftmost bearing 6 enters the oil sump 46, then it is conducted to the oil supply pasage 47 formed in the pump case 18 to lubricate the ball bearing 21 disposed in the passage 47, and thereafter flows to the exterior of the pump case 18 through the drain passage 48.

According to the present invention, as will be apparent from the above-described embodiment, in a water-cooled internal combustion engine, a driven pulley of a timing transmission mechanism is fixed to one end of the valve actuating cam shaft and a water pump of a water cooling system is directly coupled to the other end of the valve actuating cam shaft, whereby, unlike the prior art, a bending force from the timing belt or V-belt does not act on the pump shaft of the water pump, thus ensuring a light and smooth operation of the water pump. The load imposed on the pump shaft bearing is reduced thereby permitting the use of a smaller capacity bearing than in the prior art. Further, the operating characteristics and life of the mechanical seal is improved.

The invention claimed is:

1. In a water pump system for a water-cooled internal combustion engine having a valve actuating cam shaft rotatably driven, the combination of, the cam shaft having an extending end at one end of the engine, a water pump means mounted on the engine at said one end, means connecting said water pump means to said extending end of the cam shaft for driving said water pump means from the cam shaft, said water pump means including a housing with water inlet means and water outlet means, a shaft rotatably mounted in said housing, an impeller mounted on said shaft, said housing being mounted on the one end of the engine, the engine having a block and a head with port means for conducting water separately into the engine head and block, means connecting said housing water outlet means to said port means, and a valve provided on said engine head port means for controlling the flow of water to said engine head.

2. The water pump system of claim 1 wherein said valve means is responsive to the water temperature for increasing the flow of water to the engine head in response to increasing water temperature.

3. A water pump system for a water-cooled internal combustion engine having a rotatably driven cam shaft, comprising, the cam shaft having an extending end at one end of the engine, said one end of the engine having a cylindrical bore axially aligned with and surrounding the extending end of the cam shaft, a housing having a bearing cylinder projecting into said cylndrical bore and mounted on said one end of the engine at said extending end of the cam shaft, a pump shaft rotatably supported in said housing in axial alignment with and separate from the cam shaft, interconnecting terminal means on said pump shaft and cam shaft for driving said pump shaft from the cam shaft, an impeller means mounted on said pump shaft and within said housing for pumping water, and said housing having inlet and outlet means for conducting the water to and from the housing for use in cooling the engine.

4. The water pump system of claim 3 wherein the cam shaft also has an extending end at the other end of the engine, a timing belt pulley is mounted on said extending end of the cam shaft at the other end of the engine, and a timing belt means connects the engine crankshaft to said timing belt means for driving the cam shaft and in turn the pump shaft and impeller.

5. A water pump system for a water-cooled internal combustion engine having a rotatably driven cam shaft, comprising, the cam shaft having an extending end at one end of the engine, a housing mounted on said one end of the engine at said extending end of the cam shaft, a pump shaft rotatably supported in said housing in axial alignment with the cam shaft, interconnecting terminal means on said pump shaft and cam shaft for driving said pump shaft from the cam shaft, an impeller means mounted on said pump shaft and within said housing for pumping water, said housing having inlet and outlet means for conducting the water to and from the housing for use in cooling the engine, the engine having a cylinder head with a cooling water inlet means, and means provided for connecting said housing outlet means to said cylinder head inlet means and for controlling the flow of water into said cylinder head means in response to water temperature.

6. The water pump system of claim 5 wherein thermostat means are provided in said housing between said inlet means and said impeller for thermostatically controlling the flow of water through the housing.

7. A water pump system for a water-cooled internal combustion engine having a rotatably driven cam shaft extending from one end of the engine to the other, comprising, the cam shaft having an extending end at each end of the engine, a water pump housing mounted on said one end of the engine at said extending end of the cam shaft, a pump shaft rotatably supported in said housing in axial alignment with and separte from the cam shaft, interconnecting terminal means on said pump shaft and cam shaft for driving said pump shaft from the cam shaft, an impeller means mounted on said pump shaft and within said housing for pumping water, said housing having inlet and outlet means for conducting the water to and from the housing for use in cooling the engine, a timing belt pulley mounted on said extending end of the cam shaft at the othe end of the engine, and a timing belt means connecting the engine crankshaft to said timing belt pulley for driving the cam shaft and in turn the pump shaft and impeller.

* * * * *